US007726244B1

(12) United States Patent
Lloyd

(10) Patent No.: US 7,726,244 B1
(45) Date of Patent: Jun. 1, 2010

(54) MINE COUNTER MEASURE SYSTEM

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 541 days.

(21) Appl. No.: 11/880,452

(22) Filed: Jul. 20, 2007

Related U.S. Application Data

(62) Division of application No. 10/685,242, filed on Oct. 14, 2003, now abandoned.

(51) Int. Cl.
*B63G 7/02* (2006.01)

(52) U.S. Cl. ..... 102/402; 89/1.13; 102/489

(58) Field of Classification Search ..... 89/1.13; 102/402, 403, 489
See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |
| 1,300,333 | A | 4/1919 | Berry |
| 1,305,967 | A | 6/1919 | Hawks |
| 2,296,980 | A | 9/1942 | Carmichael |
| 2,308,683 | A | 1/1943 | Forbes |
| 2,322,624 | A | 6/1943 | Forbes |
| 2,337,765 | A | 12/1943 | Nahirney |
| 2,360,696 | A | 10/1944 | Long |
| 2,457,817 | A | 1/1949 | Harrell |
| 2,925,965 | A | 12/1960 | Pierce |
| 2,988,994 | A | 6/1961 | Fleischer, Jr. et al. |
| 3,092,026 | A | 6/1963 | Williams et al. |
| 3,263,612 | A | 8/1966 | Throner, Jr. |
| 3,332,348 | A | 7/1967 | Myers et al. |
| 3,464,356 | A | 9/1969 | Wasserman et al. |
| 3,474,731 | A | 10/1969 | Thomanek |
| 3,565,009 | A | 2/1971 | Allred et al. |
| 3,656,433 | A | 4/1972 | Thrailkill et al. |
| 3,665,009 | A | 5/1972 | Dickinson, Jr. |
| 3,749,615 | A | 7/1973 | Dorsey, Jr. et al. |
| 3,757,694 | A | 9/1973 | Talley et al. |
| 3,771,455 | A | 11/1973 | Haas |
| 3,796,159 | A | 3/1974 | Conger |
| 3,797,359 | A | 3/1974 | Mawhinney et al. |

(Continued)

FOREIGN PATENT DOCUMENTS

DE 3327043 A1 2/1985

(Continued)

OTHER PUBLICATIONS

Richard M. Lloyd. "Aligned Rod Lethality Enhancement Concept for Kill Vehicles," AIAA/BMDD Technology Conf., Jun. 5, Maastricht, Netherlands, 2001:pp. 1-12.

(Continued)

*Primary Examiner*—Troy Chambers
(74) *Attorney, Agent, or Firm*—Landiorio Teska & Coleman

(57) ABSTRACT

A method of destroying mines in a minefield buried under the surface includes deploying a munition including a plurality of kinetic energy rods each having a stabilizer into a position above the minefield and deploying the rods above the minefield to fall towards the minefield each aligned along a velocity vector to penetrate the surface and destroy the mines.

3 Claims, 8 Drawing Sheets

U.S. PATENT DOCUMENTS 3,818,833 A 6/1974 Throner, Jr.
3,846,878 A 11/1974 Monson et al.
3,851,590 A 12/1974 LaCosta
3,861,314 A 1/1975 Barr
3,877,376 A 4/1975 Kupelian
3,881,416 A 5/1975 Dilworth, Jr.
3,902,424 A 9/1975 Dietsch et al.
3,903,804 A 9/1975 Luttrell et al.
3,915,092 A 10/1975 Monson et al.
3,941,059 A 3/1976 Cobb
3,949,674 A 4/1976 Talley
3,954,060 A 5/1976 Haag et al.
3,977,330 A 8/1976 Held
4,015,527 A 4/1977 Evans
4,026,213 A 5/1977 Kempton
4,036,140 A 7/1977 Korr et al.
4,089,267 A 5/1978 Mescall et al.
4,106,410 A 8/1978 Borcher et al.
4,147,108 A 4/1979 Gore et al.
4,172,407 A 10/1979 Wentink
4,210,082 A 7/1980 Brothers
4,211,169 A 7/1980 Brothers
4,231,293 A 11/1980 Dahn et al.
4,289,073 A 9/1981 Romer et al.
4,353,305 A 10/1982 Moreau et al.
4,372,216 A 2/1983 Pinson et al.
4,376,901 A 3/1983 Pettibone et al.
4,430,941 A 2/1984 Raech, Jr. et al.
4,455,943 A 6/1984 Pinson
4,497,253 A 2/1985 Sabranski
4,516,501 A 5/1985 Held et al.
4,522,356 A 6/1985 Lair et al.
4,524,697 A 6/1985 Bocker et al.
4,538,519 A 9/1985 Witt et al.
4,638,737 A 1/1987 McIngvale
4,648,323 A 3/1987 Lawther
4,655,139 A 4/1987 Wilhelm
4,658,727 A 4/1987 Wilhelm et al.
4,676,167 A 6/1987 Huber, Jr. et al.
4,686,904 A 8/1987 Stafford
4,724,769 A 2/1988 Luther et al.
4,729,321 A 3/1988 Stafford
4,745,864 A 5/1988 Craddock
4,750,423 A 6/1988 Nagabhushan
4,770,101 A 9/1988 Robertson et al.
4,777,882 A 10/1988 Dieval
4,848,239 A 7/1989 Wilhelm
4,872,409 A 10/1989 Becker et al.
4,907,512 A 3/1990 Arene
4,922,826 A 5/1990 Busch et al.
4,957,046 A 9/1990 Puttock
4,960,055 A 10/1990 Dieval
4,995,573 A 2/1991 Wallow
4,996,923 A 3/1991 Theising
3,934,042 A 4/1991 Ringel
5,067,411 A 11/1991 Ball
H1047 H 5/1992 Henderson et al.
H1048 H 5/1992 Wilson et al.
5,111,748 A 5/1992 Thurner et al.
5,182,418 A 1/1993 Talley
5,191,169 A 3/1993 Hu
5,223,667 A 6/1993 Anderson
5,229,542 A 7/1993 Bryan et al.
5,313,890 A 5/1994 Cuadros
5,370,053 A 12/1994 Williams et al.
5,431,106 A 7/1995 Dunn et al.
5,524,524 A 6/1996 Richards et al.
5,535,679 A 7/1996 Craddock
5,542,354 A 8/1996 Sigler
5,544,589 A 8/1996 Held
5,565,647 A 10/1996 Kerdraon et al.
5,577,431 A 11/1996 Küsters
5,578,783 A 11/1996 Brandeis
5,583,311 A 12/1996 Rieger
5,622,335 A 4/1997 Trouillot et al.
D380,784 S 7/1997 Smith
5,661,258 A * 8/1997 Garcia et al. ..... 102/402
5,668,346 A 9/1997 Kunz et al.
5,670,735 A 9/1997 Ortmann et al.
5,691,502 A 11/1997 Craddock et al.
5,796,031 A 8/1998 Sigler
5,821,449 A 10/1998 Langsjoen et al.
5,823,469 A 10/1998 Arkhangelsky et al.
5,864,086 A 1/1999 Ettmuller
5,929,370 A 7/1999 Brown et al.
5,936,191 A 8/1999 Bisping et al.
6,010,580 A 1/2000 Dandliker et al.
6,035,501 A 3/2000 Bisping et al.
6,044,765 A 4/2000 Regebro
6,186,070 B1 2/2001 Fong et al.
6,276,277 B1 8/2001 Schmacker
6,279,478 B1 8/2001 Ringer et al.
6,279,482 B1 8/2001 Smith et al.
6,308,607 B1 * 10/2001 Woodall et al. ..... 89/1.13
6,367,388 B1 4/2002 Billings
6,439,127 B1 * 8/2002 Cherry ..... 102/519
6,540,175 B1 4/2003 Mayersak et al.
6,598,534 B2 7/2003 Lloyd et al.
6,621,059 B1 9/2003 Harris et al.
6,622,632 B1 9/2003 Spivak
6,640,723 B2 11/2003 Spivak et al.
6,666,145 B1 12/2003 Nardone et al.
6,766,745 B1 * 7/2004 Kuklinski et al. ..... 102/402
6,779,462 B2 8/2004 Lloyd
6,883,414 B2 * 4/2005 Lowery et al. ..... 89/1.13
6,910,423 B2 6/2005 Lloyd
6,920,827 B2 7/2005 Llyod
6,931,994 B2 8/2005 Lloyd
6,973,878 B2 12/2005 Lloyd et al.
7,017,496 B2 3/2006 Lloyd
7,040,235 B1 5/2006 Lloyd
7,066,093 B2 6/2006 Ronn et al.
2003/0029347 A1 2/2003 Lloyd
2004/0055498 A1 3/2004 Lloyd
2005/0066848 A1 3/2005 Muskat et al.
2005/0109234 A1 5/2005 Lloyd
2005/0132923 A1 6/2005 Lloyd
2006/0021538 A1 2/2006 Lloyd

FOREIGN PATENT DOCUMENTS

DE 38 30 527 3/1990
DE 3934042 A1 4/1991
EP 270 401 6/1988
EP 0872705 4/1998
FR 2678723 A1 1/1993
GB 550001 12/1942
GB 2236581 4/1991
JP 1-296100 11/1989
WO WO97/27447 7/1997

OTHER PUBLICATIONS

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 2, pp. 19-77.

Gonor et al., "Aerodynamic Characteristics of Star-Shaped Bodies During Supersonic Speeds", News of the Soviet Academy of Sciences (Isv. AN SSSR), MZHG, 1971, No. 1, pp. 97-102.

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.
FAS Military Analysis Network (http://www.fas.org/man/dod-101/sys/land/m546.htm): M546 APERS-T 105-mm, Jan. 21, 1999 (1 page).
FAS Military Analysis Network (http://www.fas.org/man/dod-101/sys/land/bullets2.htm): Big Bullets for Beginners, Feb. 6, 2000 (13 pages).
Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.
Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.
BGM-109 Tomahawk, FAS Military Analysis Network, Nov. 12, 2001 (8 pages).
Cruise Missile, Wilipedia, the free encyclopedia, date unknown (4 pages).
U.S. Appl. No. 10/924,104, filed Aug. 23, 2004, Richard M. Lloyd.

* cited by examiner

MINE COUNTER MEASURE SYSTEM

RELATED APPLICATIONS AND PRIORITY CLAIM

This application is a divisional application of prior U.S. patent application Ser. No. 10/685,242 filed on Oct. 14, 2003 now abandoned which is incorporated into this application by reference, and to which this application claims priority.

FIELD OF THE INVENTION

This invention relates to a land mine counter measure system.

BACKGROUND OF THE INVENTION

Land mines pose a severe threat to military and civilian personnel. The idea of detonating land mines using conventional weapons and ordnances is known but such methods are not very effective or efficient since many ordnances would be required to detonate the numerous possible land mines in a given area.

One current idea is to deploy a net carrying shape charges onto the land mine field. But, never is there a guarantee that all the land mines would be detonated and, worse, some shape charges could fail to detonate resulting in an added explosive danger to personnel who then enter onto the land mine field. Also, this approach would not be used during a war where troops are required to engage the enemy from the beach.

Also, land mines are often buried 6 inches beneath the sand on a beach and also beneath the sand under two or more feet of water. Conventional approaches fail to effectively counter such tactics during wartime.

SUMMARY OF THE INVENTION

It is therefore an object of this invention to provide a better land mine counter measure system.

It is a further object of this invention to provide such a system which is highly effective and which can be used during armed conflict.

It is a further object of this invention to provide such a system which is efficient.

It is a further object of this invention to provide such a system which leaves no unexploded ordnances on the land mine field.

It is a further object of this invention to provide such a system which can efficiently and effectively detonate land mines buried in the sand and also under the water.

The invention results from the realization that a more efficient and effective land mine counter measure system is effected by spraying the land mine field with a number of arrow-like kinetic energy rods each aligned about its velocity vector to better penetrate the surface (sand or sand and water) above the mines.

This invention features a mine counter measure system comprising a housing, an explosive in the housing, and a plurality of kinetic energy rods in the housing about the explosive. Each rod has a stabilizer for aligning the rod about its velocity vector to better penetrate the surface above a mine.

In one example, each rod has a length to diameter ratio of greater than 5 and preferably a length to diameter ratio greater than or equal to 10. In one embodiment, the stabilizer is a plurality of fins on the distal end of each rod. In another embodiment, the stabilizer is a flared distal end of the rod. Typically, the proximal end of each rod is pointed. In one example, the proximal end of each rod includes a poly-wedge shape to decrease the drag on the rod. Also, it is preferred that the center of gravity of each rod is proximate the distal end of the rod to orient the proximal end of the rod downward.

Further included may be a foam body in the housing between the rods and the explosive. Or, there may be a foam body in the housing about the rods between the housing and the explosive. In one example, the rods are packaged in coaxially aligned rings and there are coaxially aligned foam bodies between each ring of rods.

The rods may have a circular cross sectional shape, a cruciform cross sectional shape, or a tristar cross sectional shape.

In one example, the housing is a shell. In another example, the housing is a payload. Further included may be a missile for deploying a plurality of said payloads. Typically, the rods are staggered in the housing for better packaging efficiency.

One mine counter measure system in accordance with this invention includes a housing, an explosive in the housing, a plurality of kinetic energy rods in the housing about the explosive, each rod having a stabilizer for aligning the rod about its velocity vector to better penetrate the surface above a mine, each rod having a length to diameter ratio of greater than or equal to 10, each rod having a poly-wedge shaped proximal end, and foam in the housing between the rods and the explosive core.

One mine counter measure system in accordance with this invention features a plurality of munition housings each including, an explosive, and a plurality of kinetic energy rods about the explosive, each rod having a stabilizer for aligning the rod about its velocity vector to better penetrate the surface above a mine and each rod including a poly-wedge shaped tip to decrease the drag on the rod and a length to diameter ratio of greater than or equal to 10. A carrier deploys the munition housings over a minefield.

This invention also features a method of destroying mines in a minefield buried under the surface. The method comprises deploying a munition including a plurality of kinetic energy rods each having a stabilizer into a position above the minefield and deploying the rods above the minefield to fall towards the minefield each aligned along a velocity vector to penetrate the surface and destroy the mines.

In one example, a plurality of the minefields are carried to a position above the minefield and deploying includes detonating an explosive core in each minefield surrounded by the rods.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
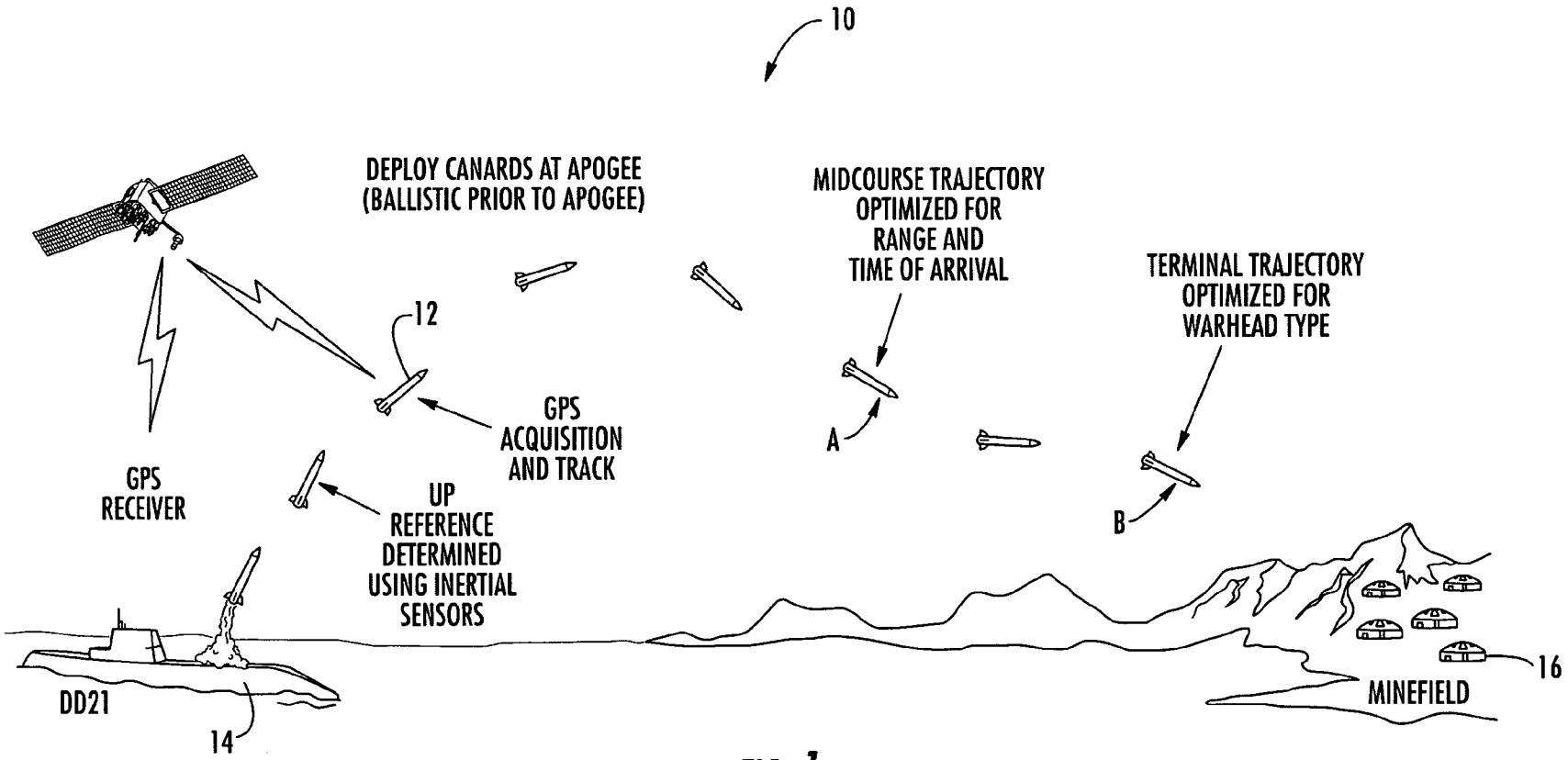
FIG. 1 is a schematic view showing the deployment of the mine counter measure system of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

Mine counter measure system 10, FIG. 1 includes, in one example, missile 12 deployed from ship or submarine 14 or other launcher. In this specific example, missile 12 is an XM 982 Excalibur 155 mm long range guided missile with GPS tracking capability and having a trajectory optimized for range and time of arrival at position A and then having a trajectory optimized for rod delivery at position B over minefield 16. Other ordnances and delivery mechanisms, however, are within the scope of this invention.

Figure 2:
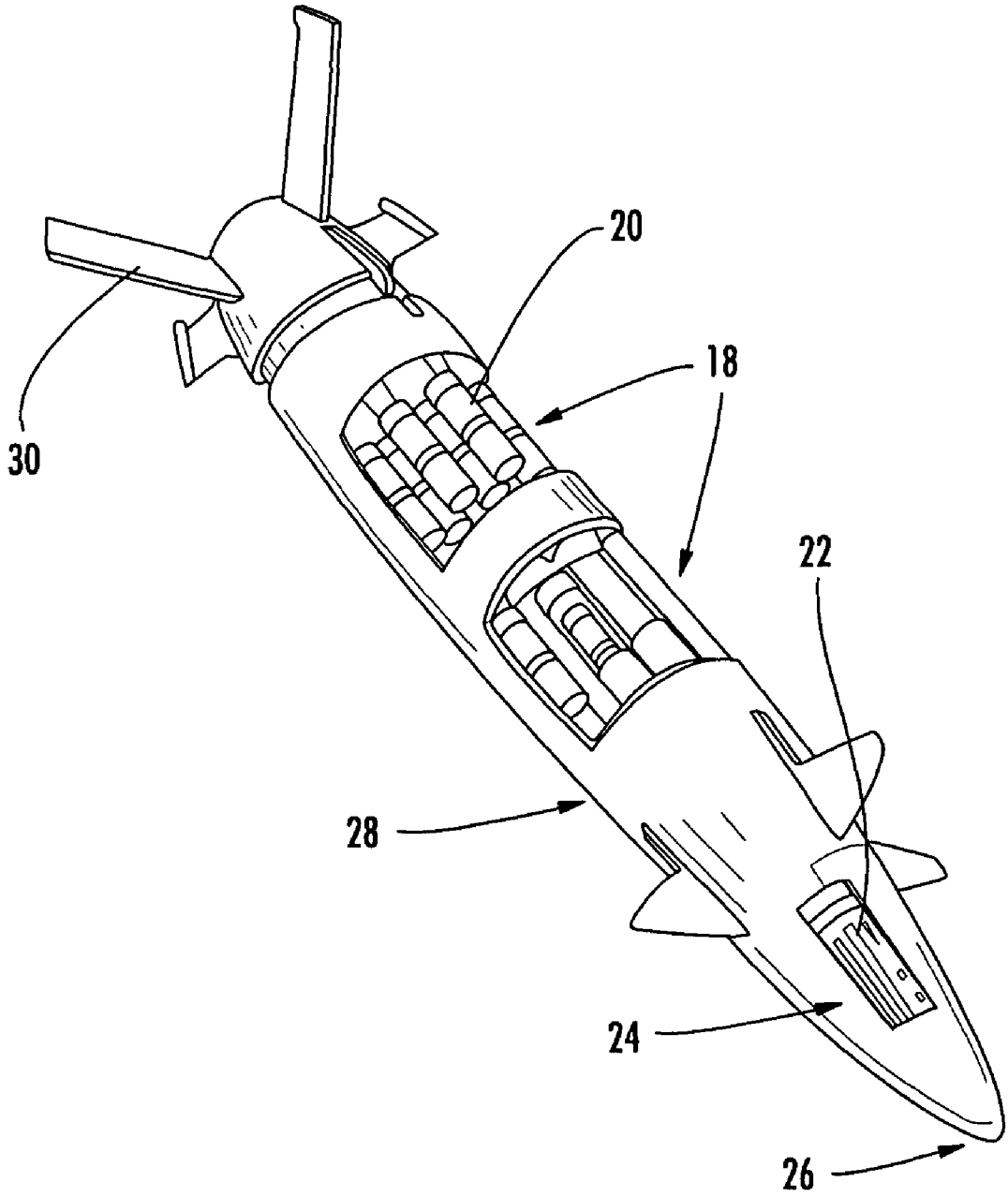
FIG. 2 is a schematic three-dimensional view showing one embodiment of a projectile for deploying the munitions of the subject invention.

As shown in FIG. 2, missile 12 includes bays 18 housing deployable munitions, shells, or other payloads 20 discussed infra. Missile 12 also includes antijam GPS/IMU navigation section 22, guidance and electronic unit section 24, inductive fuse setter interface 26, control and actuator section 28, and fin stabilizer base section 30.

Figure 3:
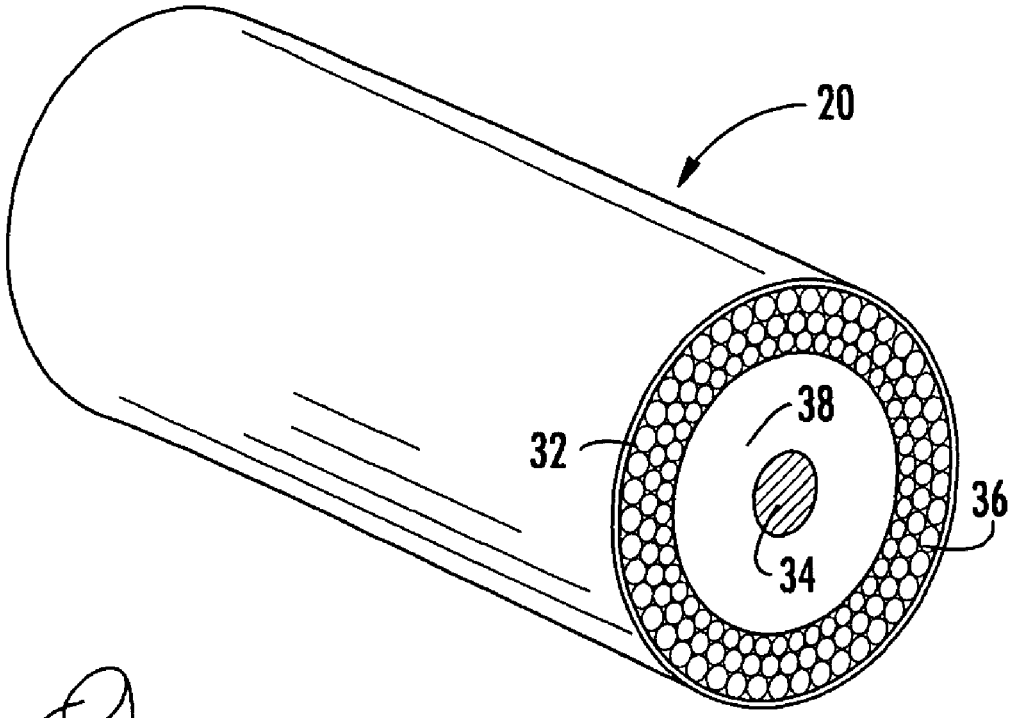
FIG. 3 is a schematic three-dimensional view showing one embodiment of a munition in accordance with the subject invention.
Figure 4:
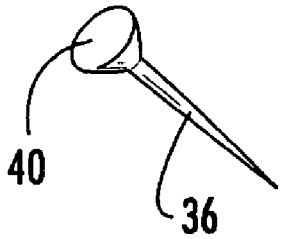
FIG. 4 is a schematic three-dimensional view showing one embodiment of a kinetic energy rod in accordance with the subject invention.
Figure 5:
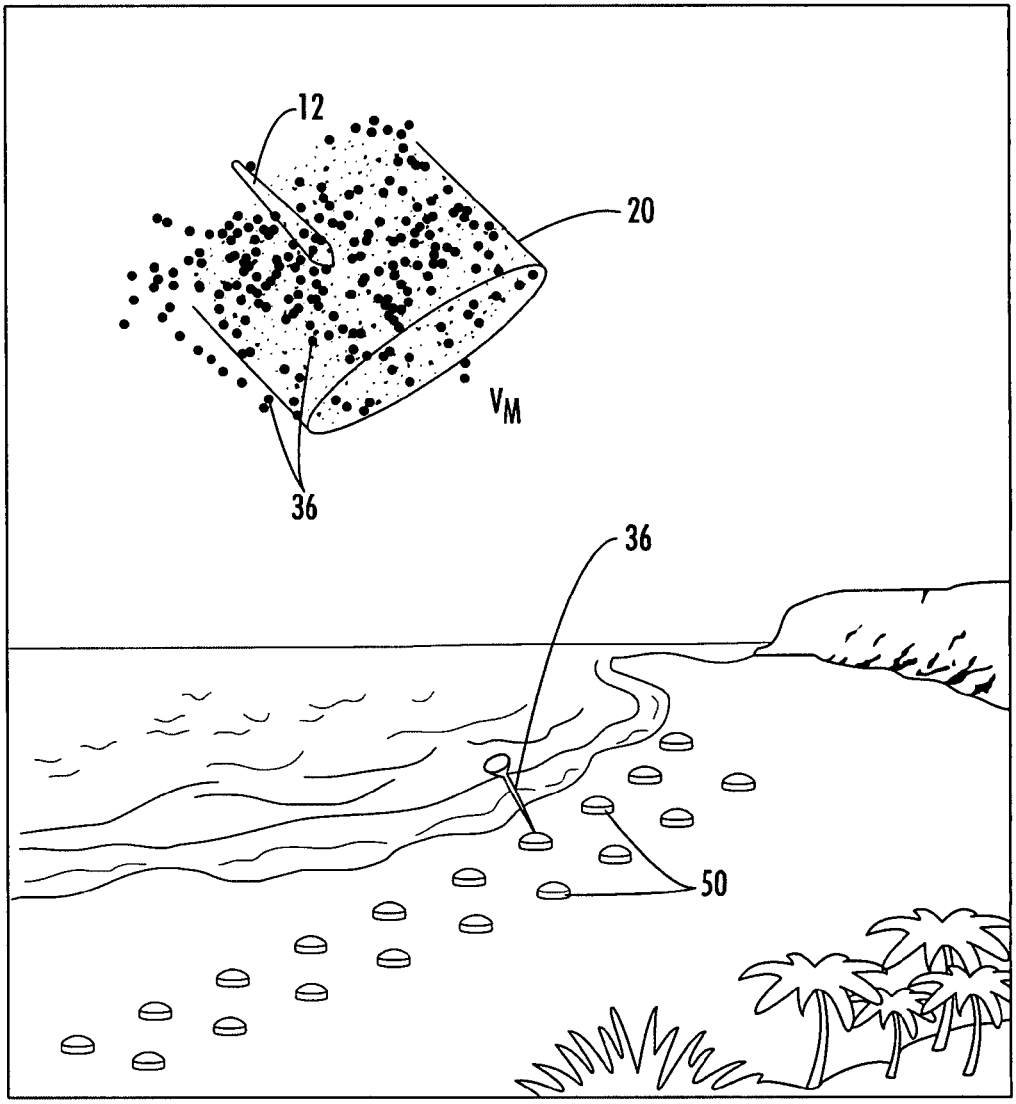
FIG. 5 is a schematic view showing the deployment of the kinetic energy rods of FIG. 4 from the munition of FIG. 3 onto a minefield.

As shown in FIG. 3, each munition or shell 20 includes munition housing 32, explosive core 34, and a number of kinetic energy rods 36 in housing 32 about core 34. Typically, foam body 38 is included between rods 36 and explosive core 34. To align each rod about its velocity vector to better penetrate the surface (e.g., sand and/or water) above a land mine, each rod 36, FIG. 4 includes some kind of stabilizer 40 which, in this example, is a flared end. Preferably, each rod is made of tungsten or tantalum and has a length to diameter ratio of greater than 5 and typically greater than or equal to 10. As shown in FIG. 5, mines 50 are buried beneath sand and/or water and missile 12, FIGS. 1-2 has reached deployment position B, FIG. 1 whereupon munitions 20, FIGS. 2-3 are deployed and explosive core 34, FIG. 3 detonated which sprays rods 36, FIG. 5 into a desired pattern, each rod aligned along its velocity vector to penetrate the surface above a mine 50 thereby destroying it.

The result is effective and efficient mine destruction without the possibility of leaving unexploded ordnances on the minefield.

Figure 6:
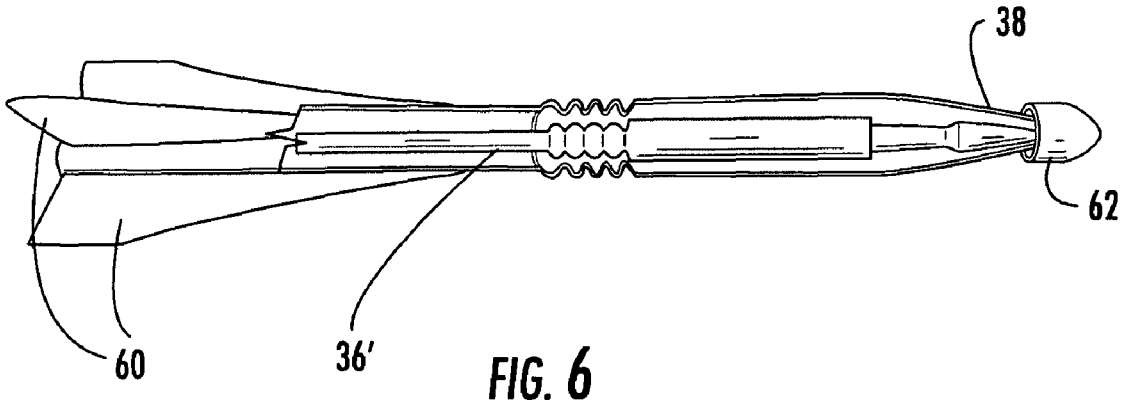
FIG. 6 is a schematic three-dimensional view showing another embodiment of a kinetic energy rod in accordance with the subject invention.

In FIG. 6, kinetic energy rod 36' includes a stabilizer in the form of fins 60 on the distal end of each rod and the proximal end of rod 36 includes pointed poly-wedge shaped tip 38 and penetrator nose 62 designed to reduce air drag (CD) allowing the penetrator to fly faster for longer period of time and enhance its over all stability. There has been much work on the design of these nose shapes. See Gonor A. L., Kazakov M. N., Shvets A. I. Aerodynamic characteristics of star-shaped bodies during supersonic speeds, News of the Soviet Academy of Sciences (Izv. AN SSSR). MZHG. 1971, No 1, p. 97-102 incorporated herein by this reference. It is also preferred that the center of gravity of each rod is located proximate the distal end of the rod to orient the proximal end of the rod downward upon deployment from missile 12, FIG. 5.

Figure 7:
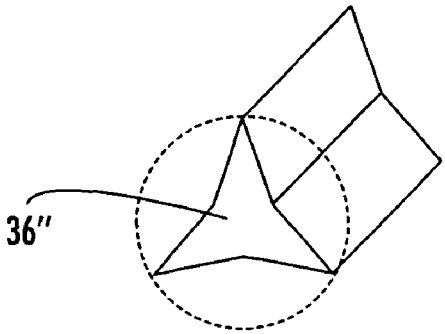
FIG. 7 is a schematic three-dimensional view showing a tristar rod configuration in accordance with the subject invention.
Figure 8:
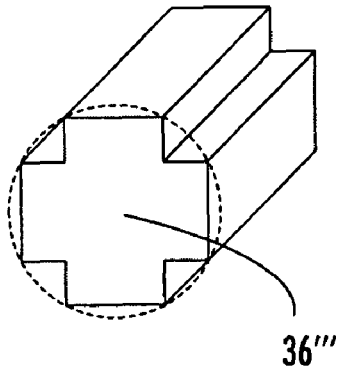
FIG. 8 is a schematic three-dimensional view showing a cruciform rod configuration in accordance with the subject invention.
Figure 9:
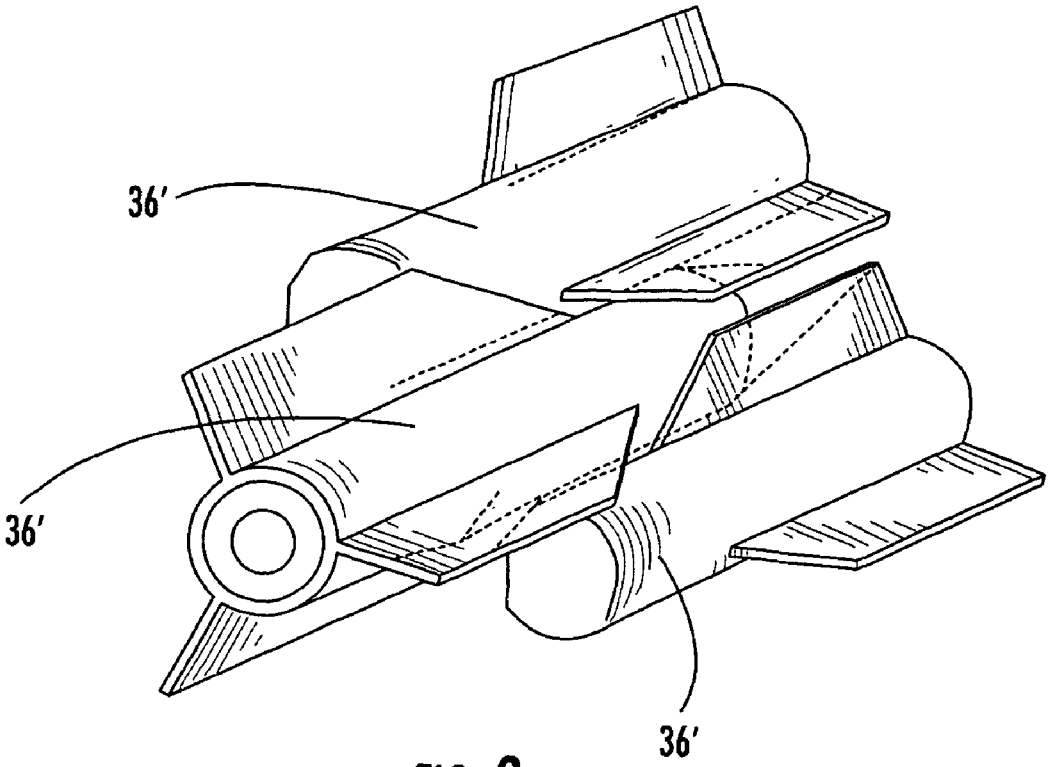
FIG. 9 is a schematic partial view showing staggered kinetic energy rods for better packaging efficiency in accordance with the subject invention.

The rods may also have a non-circular cross section as shown for rod 36", FIG. 7 (a tristar configuration), and rod 36'", FIG. 8, (a cruciform construction). As shown in FIG. 9, the fins of the rods can be staggered in the munition or shell for better packaging efficiency.

Figure 10:
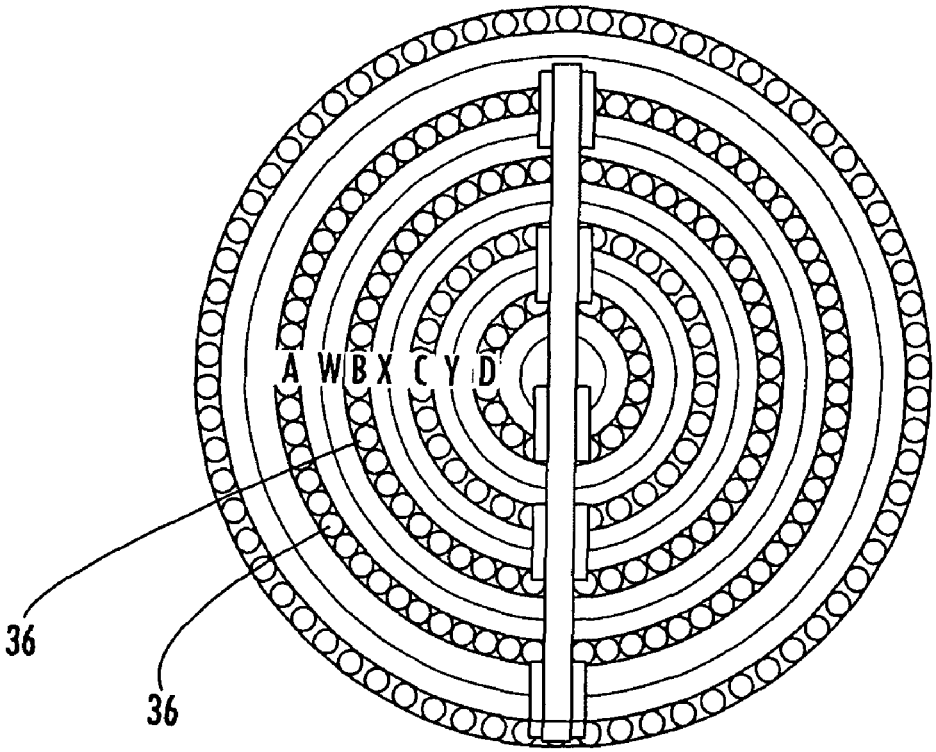
FIG. 10 is a cross-sectional view showing one example of a munition with a number of kinetic energy rods in accordance with the subject invention.

In FIG. 10, rods 36 are packaged in coaxially aligned rings A, B, and D with coaxially aligned rings W, X, and Y of foam between each adjacent ring of rods. The explosive used between each ring would typically be a DETASHEET or a PBX based explosive.

Figure 11:
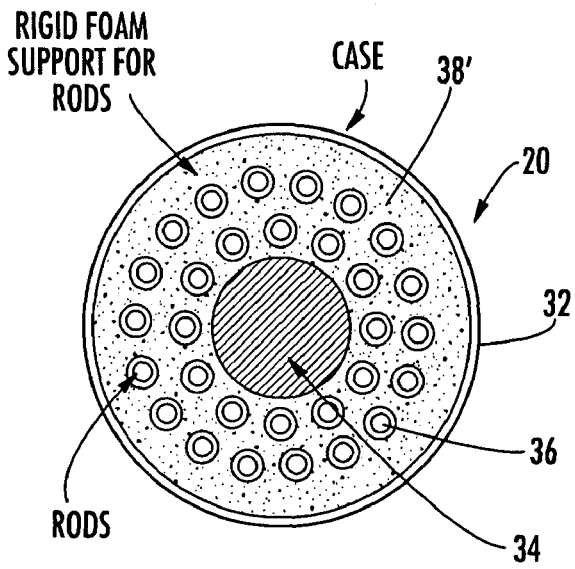
FIG. 11 is a cross sectional view showing another example of a munition with a number of kinetic energy rods in accordance with the subject invention.

In FIG. 11, foam body 38' is about rods 36 between housing 32 and explosive core 34. Also, munition 20 may be a shell launched, for example, from a gun subsystem as opposed to missile 12, FIGS. 1-2. Munition 20 would then include a time delay or altitude fuse for deploying core 34. The munition rounds are fired toward the beach at high velocity. The desired dispersal spray pattern and mine spacing will determine the optimum altitude to deploy the rods. The rods are isotropically deployed creating a uniform spray pattern about the munition center axis. The rods became stabilized shortly after explosive deployment because of the tail fin design. The unique nose shape reduces the penetrator drag ensuring high impact velocity into the mine field. Each rod penetrates the sand or water at high enough velocity to detonate the explosive.

Figure 12:
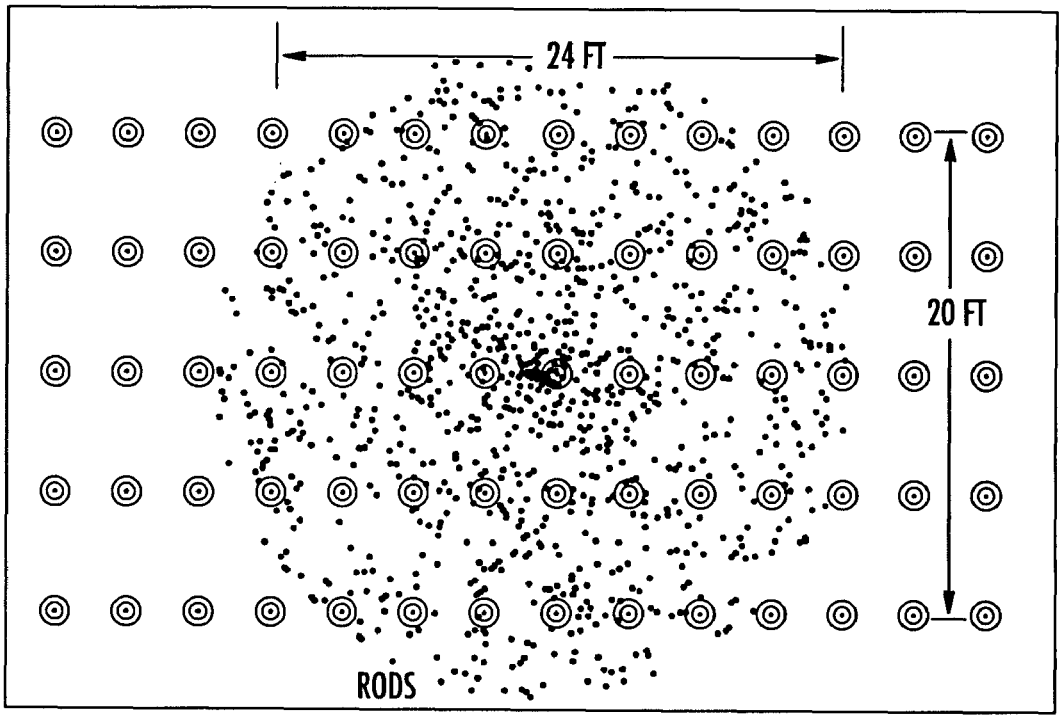
FIG. 12 is a drawing which characterizes the lethality of the mine counter measure system of the subject invention.

FIG. 12 demonstrates the high lethality obtained by the system of this invention based on computer modeling. A generic minefield was generated and each mine was placed three feet apart while each row was five feet apart. A highly dense spray pattern of 30 gm rods with a length to diameter ratio of 10 impacting the minefield nearly kills all of the mines in a 10 foot by 12 foot area. With a 1000 rods and a burst point at a higher altitude, there is a significant increase in the number of mines that were hit with multiple rod impacts. This calculation demonstrates that an extremely large area minefield can be made safe provided that the proper burse point for a given number of projectiles is selected.

The system of the subject invention also takes into account the effects of water and sand on penetration. Mines that lie on shore can be covered with up to 6 inches of dry or wet sand while mines in the surf zone can be covered with sand and water up to 2 feet.

Figure 13:
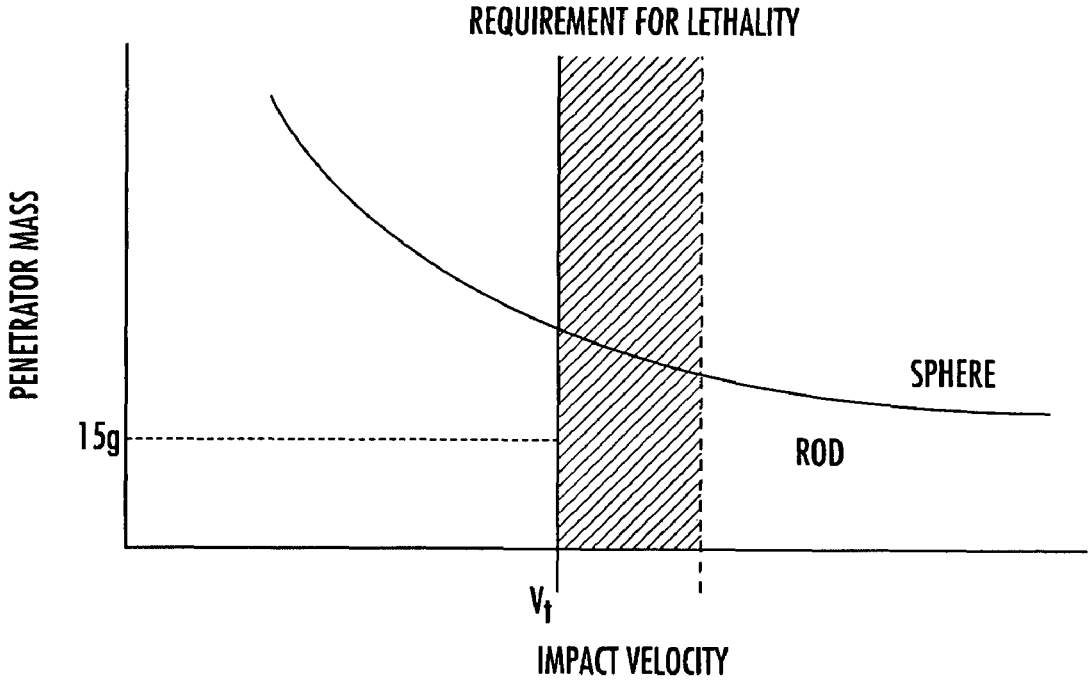
FIG. 13 is a graph comparing penetrator mass to impact velocity.

FIG. 13 shows the design trade-offs between the optimum penetrator concept. If a sphere is used, then it would require a larger mass compared to a slender long rod. A rod is a much more efficient penetrator compared to a sphere. However, the longer the rod becomes the more precise is most impact with low yaw angles. If the penetrator is not aligned then it will not penetrate well and fail to kill the buried mine. Since all weapons are weight restricted, the lightest weight penetrator is the best for optimum lethality.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. For example, selected structures and techniques of co-pending patent applications Nos. 09/938,022; 10/162,498; 10/301,302; 10/301,420; 10/384,804; 10/385,319; and 10/370,892, herein incorporated by this reference, may also be used in the connection with the subject invention. Other embodiments will occur to those skilled in the art and are within the following claims:

What is claimed is:

1. A method of destroying mines in a minefield buried under the surface, the method comprising:

deploying a munition including a plurality of kinetic energy rods each having a stabilizer into a position above the minefield; and deploying the rods above the minefield to fall towards the minefield each aligned along a velocity vector to penetrate the surface and destroy the mines.

2. The method of claim 1 in which deploying includes carrying a plurality of said munitions to a position above the minefield.

3. The method of claim 2 in which deploying includes detonating an explosive core in each munition surrounded by the rods.

* * * * *